United States Patent [19]

Sanders, Jr. et al.

[11] Patent Number: 4,515,488

[45] Date of Patent: May 7, 1985

[54] ASSEMBLING DOT MATRIX PRINT HEADS

[75] Inventors: Royden C. Sanders, Jr., Burton Hwy., Wilton, N.H. 03086; John L. Forsyth, Newton Junction, N.H.

[73] Assignee: Royden C. Sanders, Jr., Wilton, N.H.

[21] Appl. No.: 626,668

[22] Filed: Jul. 2, 1984

[51] Int. Cl.[3] ..... B41J 3/12

[52] U.S. Cl. ..... 400/124; 29/602 R; 29/606; 101/93.05

[58] Field of Search ..... 400/124; 101/93.05; 29/436, 464, 468, 592 R, 602 R, 606

[56] References Cited

U.S. PATENT DOCUMENTS

| | | | |
|---|---|---|---|
| 3,145,464 | 8/1964 | Green | 29/464 |
| 3,169,302 | 2/1965 | Tethal | 29/464 |
| 3,775,842 | 12/1973 | Sheldon et al. | 29/602 X |
| 3,786,562 | 1/1974 | Ciszewski | 29/602 |
| 4,016,637 | 4/1977 | Swensen | 29/464 X |
| 4,156,960 | 6/1979 | Ikeda | 29/464 X |
| 4,325,797 | 4/1982 | Hale et al. | 29/592 R X |

FOREIGN PATENT DOCUMENTS

| | | | |
|---|---|---|---|
| 53586 | 4/1977 | Japan | 29/464 X |

*Primary Examiner*—Paul T. Sewell

*Attorney, Agent, or Firm*—Hayes, Davis & Soloway

[57] ABSTRACT

The method of assembling a dot matrix print pin driving spring in relation to a solenoid having an axial hole, the spring carrying a cylindrical armature and the hole being designed for receiving the cylindrical armature, the solenoid being carried by a housing, positioning a plastic sheet adjacent the hole, with an edge of the plastic sheet overlying the hole, inserting the armature into the hole thereby partially drawing the plastic sheet into the hole so that it engages more than 180° of circumference of the armature to center the armature in the hole.

13 Claims, 6 Drawing Figures

ASSEMBLING DOT MATRIX PRINT HEADS

BACKGROUND OF THE INVENTION

In the copending application of Sanders and Forsyth, Ser. No. 544,397, filed Oct. 21, 1983, there is described a dot matrix print head designed for high speed operation having rugged construction and low cost. In the assembly of such dot matrix print heads it is essential, to achieve the design objectives of high performance and low cost, that the armature carried by the pin driving spring be accurately positioned with respect to the armature receiving hole in the solenoid. There are certain manufacturing tolerances in devices of this type where only a few thousandths of an inch can make a tremendous difference in the reliability and smooth operation of the print pin. This can require permanent jigs and fixtures which are expensive and sometimes not completely satisfactory.

In dot matrix print heads of the type described in the above mentioned patent application, the print head is moving constantly across the sheet and the firing of each individual print wire is controlled by a computer in accordance with the predicted position of the particular print wire across the sheet at any given instant of time to provide a small portion of the desired character. Since the print head is capable of operating at 3,000 impulses per second for each print wire, and since the print head may be moving across the sheet at 52 inches per second, each print wire must make its impact with the sheet within a time frame of only 40 microseconds if it is to form the desired character. Any impact outside of the 40 microseconds window will distort the printed image.

As a result of this critical time dependency of the impact with respect to motion of the print head, it is extremely critical that each print wire have the same response time to the firing pulse. This means that, insofar as is mechanically possible, each wire driving armature must be precisely centered with respect to its solenoid and the gap should be as small as possible consistent with reasonable manufacturing techniques. If the armature is not precisely centered, it may rub against the side of the hole, thereby enormously increasing frictional force to be overcome in moving the armature. Also it will otherwise change the response time. When each print wire is designed of the same mass, each armature has the same mass and each is assembled in identical solenoid, each one can have a response time within 20 microseconds of each other print wire so that optimum printing quality will be obtained with electrical firing pulses of the same length sent to each printing solenoid in proper sequence.

Accordingly it is the object of the present invention to provide a simple and inexpensive method for assembling print driving springs carrying an operating armature in fixed coaxial relation to its driving solenoid.

SUMMARY OF THE INVENTION

In the method of assembling the dot matrix print pin driving spring it is necessary that the armature carried by this spring be positioned as nearly as possible coaxial with the axial hole in the solenoid. The leaf spring supporting the armature and the print pin has a rear portion opposite the print pin for fixing the spring to the housing carrying the solenoid. This can conveniently be several screws or other fastening mechanism which can be quite accurate in holding the armature in the center of the actual hole in the solenoid. However, since even a slight movement of the armature with respect to the axis of the screw hole during fastening can create misalignment it is essential that during the tightening of the fastening means that the armature be held coaxially with the solenoid hole. This also permits adjustment between any tolerance in the hole fastening means along the length of the spring armature as well as transverse to it.

In the present invention, this alignment is accomplished inexpensively and simply by providing one or more flexible spacer elements around the periphery of the armature while it is initially inserted into the solenoid hole. This spacer is preferably a plastic sheet which is positioned adjacent the hole with an edge of the plastic sheet overlying the hole. This plastic sheet is on the order of the thickness of the radial spacing between the outside of the armature and the inside of the axial hole in the solenoid. In a preferred form of the invention at least two edges of the sheet overly the hole and as the armature is inserted during assembly into the hole it partially draws the plastic sheet into the hole so that the plastic sheet is positioned between the armature and the inside of the hole. Preferably the plastic sheet is positioned at three or more points spaced around the circumference of the armature by more than 180°. Thus the armature is effectively centered with respect to the hole. The spring can then be firmly secured at the fastening means to provide the necessary predetermined coaxial relationship between the armature and the hole. After the fastening means is set the armature is allowed to partially come out of the hole as a result of the spring action in the pin driving spring and the plastic sheet(s) are then withdrawn, the armature now being free to move in perfect alignment with the axis of the solenoid hole.

DETAILED DESCRIPTION OF THE INVENTION

In order to more fully appreciate the specific preferred form of the invention reference should be had to the following diagrammatic, schematic drawings which show the preferred embodiment as well as a number of alternate forms thereof:

Figure 1:
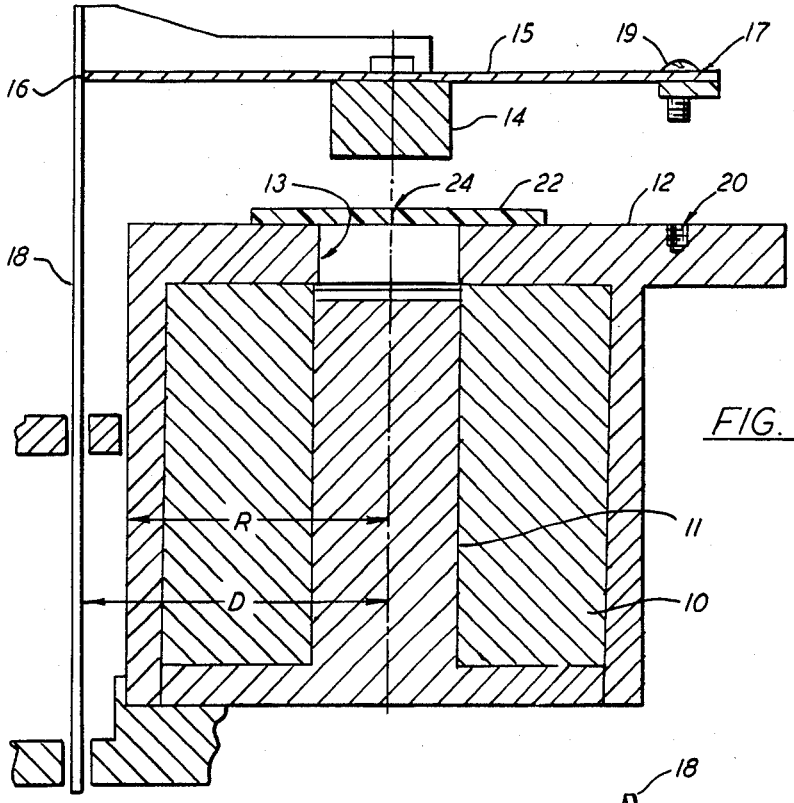
FIG. 1 is a schematic, diagrammatic, partially sectional view of a portion of a print head of the type described in the above copending application at FIG. 6.
Figure 3:
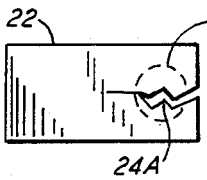
FIGS. 3–6 show other types of spacer elements that can be used in the present invention.
Figure 2:
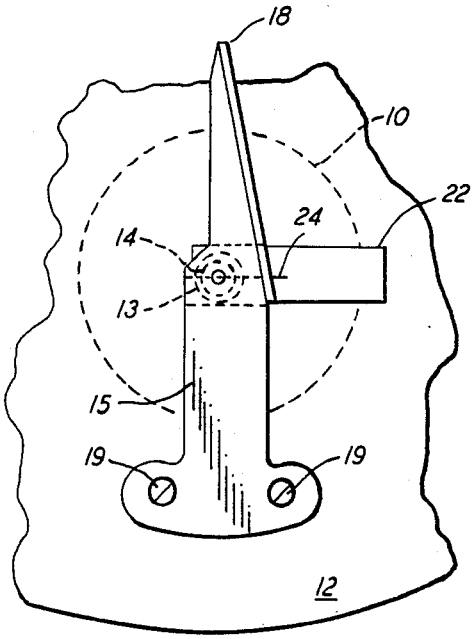
FIG. 2 is a schematic, diagrammatic plan view of the print spring arm in relation to the solenoid with the preferred thin plastic sheet in position for start of assembly.

Referring now to FIG. 1 there is shown a dot matrix print head comprising an actuating solenoid (10) having a core element (11). Surrounding the solenoid is a magnetic return path formed in part by a plate (12) at the top of the solenoid this plate having a hole (13) which is coaxial with the core and the axis of the solenoid. The print driving spring (15) carries an armature (14) which is designed to be positioned coaxially in the hole (13) so as to be pulled downwardly towards the core when the solenoid is energized. Spring (15) has an outer end (16) to which is secured the print wire (18). At the opposite end of spring (15) is the part of the fastening means (17) which includes a pair of screws (19) (see FIG. 2) arranged to be secured into screw holes (20) which are formed in either the magnetic return path (12) or a portion of the housing held in fixed relation thereto. The print spring and its armature are shown in FIG. 1 in the position ready for assembly, the armature being positioned above but in axial alignment with the hole (13). Overlying the hole (13) there is positioned a thin sheet of plastic constituting the spacing means (22). This plastic sheet has a slit (24) and, as seen in plan view FIG. 2, the end of the plastic sheet adjacent the slit (24) is positioned so that it overlies the hole (13). With this arrangement, as the armature (14) is moved down into the hole, the plastic sheet is drawn into the hole and engages the armature around more than 180° of circumference thereof so as to acurately center the armature in the hole. The screws (19) are then securely fastened, thus holding the spring armature rigidly spaced with respect to the axis of the hole (13). Thereafter the spring tension compression is released allowing the armature to move up slightly due to the natural bend in the spring and the spacer element (22) is then withdrawn leaving the armature securely and axially aligned with the hole (13).

In a preferred embodiment of the invention, the radial distance from the outside of the armature (14) and the inside of the hole (13) is made about 0.002 inch. This provides adequate tolerance for mass production technology without seriously interfering with the integrity of the magnetic return path. Obviously, the gap between the armature and the magnetic return path should be as small as possible consistent with normal manufacturing tolerances to increase the magnetic efficiency and decrease the amount of current necessary to drive the solenoid (10). With the above preferred radial spacing of 0.002 inch it is preferred that the spacer sheet (22) have a thickness of about 0.002 inch. With a preferred spacer made of polyethylene it has the advantages that it has a low coefficient of friction, permitting ease of withdrawal. Polyethylene is also compressible which is helpful if the radial gap is less than the desired 0.002 inch due to manufacturing imperfections. Polyethylene is also stretchable so that it becomes thinner, thus permitting easier withdrawal. Even if the polyethylene is slightly thinner (by 0.0005 inch) than the radial spacing between the exterior of the armature and the interior of the hole, it will provide adequate centering of the armature (4) to give the desired uniformity of response between one print driving armature and the next one in the print head.

Referring now to FIGS. 3 through 6 there are shown various alternative designs for the spacer means. As can be seen, this can take many different arrangements. For example, in FIG. 3 the slit (24*a*) can be saw-toothed to provide a number of discrete points which are carried into the hole (13).

Figure 4:
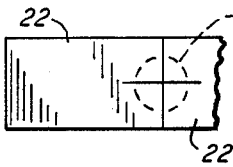

In FIG. 4 there are shown two pieces (22) which overly the hole (13).

Figure 5:
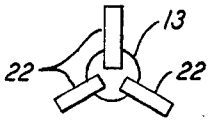

In FIG. 5 the spacer comprises three smaller plastic strips (22) extending radially from the center of the hole.

Figure 6:
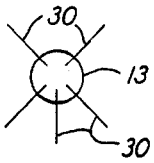

In FIG. 6 the spacer elements comprise a plurality of threads (3*a*) (mono or multifilament) which can be of plastic or metal arranged around the periphery of the hole to act as spacers for centering the armature during the securing of the fastening means.

While several preferred embodiments of the invention have been described above, it is apparent that many modifications thereof can be provided without departing from the spirit of the invention, as will be apparent to one of ordinary skill in the art on the basis of the teachings herein.

The embodiments described refer to an armature (14) of a cylindrical form. It will be appreciated that the present invention is applicable to armatures with cross-sectional forms of shapes, for example, triangular, square, rectangular, hexagonal, etcetara.

We claim:

1. The method of assembling a dot matrix print pin driving spring in relation to a solenoid having an axial hole, said spring carrying an armature and said hole being designed for receiving said armature, said solenoid being carried by a housing, positioning a plastic sheet adjacent the hole, with an edge of the plastic sheet overlying the hole, inserting the armature into the hole thereby partially drawing the plastic sheet into the hole so that it engages more than 180° of surface of the armature as measured around the axis of the hole to center the armature in the hole.

2. The method of assembling a dot matrix print pin driving spring in relation to a solenoid having an axial hole, said spring carrying a cylindrical armature and said hole being designed for receiving said cylindrical armature, said solenoid being carried by a housing, positioning a spacer means adjacent the hole, with an edge of the spacer means overlying the hole, inserting the armature into the hole thereby partially drawing the spacer means into the hole so that it engages portions of the interior of the hole spaced about more than 180° of circumference of the armature to center the armature in the hole.

3. The method of assembling a dot matrix print pin as described in claim 2 wherein the spacer means engages at least 3 points spaced around the circumference by more than 180° of the armature to center the armature in the hole.

4. The method of assembling a dot matrix print pin as described in claim 1 wherein at least two edges of the plastic sheet overly the hole.

5. The method of assembling a dot matrix print pin as described in claim 2 wherein the spacer means comprises a plastic sheet having a thickness on the order of the radial spacing between the outside of the armature and the inside of the hole.

6. The method of assembling a dot matrix print pin as described in claim 2 wherein the spacer means comprises at least two plastic sheets having a thickness on the order of the radial spacing between the outside of the armature and the inside of the hole.

7. The method of assembling a dot matrix print pin as described in claim 2 wherein the spacer means comprises at least three plastic sheets having a thickness on the order of the radial spacing between the outside of the armature and the inside of the hole.

8. The method of assembling a dot matrix print pin as described in claim 2 wherein the spacer means comprises several flexible threads having a thickness on the order of the radial spacing between the outside of the armature and the inside of the hole.

9. The method of claim 5 wherein the plastic sheet has a slit which extends over the hole.

10. A partially assembled dot matrix print head comprising a dot matrix print pin driving spring in relation to a solenoid having an axial hole, said spring carrying a cylindrical armature and said hole being designed for receiving said cylindrical armature, said solenoid being carried by a housing, a plastic sheet removably inserted in the hole to center the cylinder so that the sheet engages portions of the interior of the hole spaced about more than 180° of circumference, means for rigidly securing said armature spring to a portion of a housing bearing a predetermined relation to the hole.

11. A partially assembled dot matrix print head comprising a dot matrix print pin driving spring in relation to a solenoid having an axial hole, said spring carrying a cylindrical armature and said hole being designed for receiving said cylindrical armature, said solenoid being carried by a housing, at least two spacer elements having a thickness on the same order as the radial spacing between the outside of the armature and the inside of the hole, said spacer elements being spaced around the circumference of the hole by more than 180°, and means for rigidly securing said armature spring to a portion of a housing bearing a predetermined relation to the hole.

12. The method of claim 5 wherein the plastic sheet is elastic and compressible.

13. The method of claim 5 wherein the plastic sheet is polyethylene.

* * * * *